US005896912A

United States Patent [19]

Monroe et al.

[11] Patent Number: 5,896,912

[45] Date of Patent: Apr. 27, 1999

[54] METHOD AND APPARATUS FOR CASTING A VEHICLE WHEEL IN A PRESSURIZED MOLD

[75] Inventors: Brian K. Monroe, Huntington, Ind.; S. Joe Kingrey, Flowery Branch, Ga.; Romulo A. Prieto, Northville; Bor-Liang Chen, Ann Arbor, both of Mich.

[73] Assignee: Hayes Wheels International, Inc., Romulus, Mich.

[21] Appl. No.: 08/744,851

[22] Filed: Nov. 8, 1996

Related U.S. Application Data

[63] Continuation-in-part of application No. 08/430,069, Apr. 27, 1995, abandoned.

[51] Int. Cl.[6] ..... B22D 1/00; B22D 17/06; B22D 27/13

[52] U.S. Cl. ..... 164/134; 164/119; 164/306; 164/342; 164/358

[58] Field of Search ..... 164/134, 113, 164/119, 306, 342, 358

[56] References Cited

U.S. PATENT DOCUMENTS

| | | | |
|---|---|---|---|
| 2,500,556 | 3/1950 | Mallach . | |
| 3,664,411 | 5/1972 | Carver et al. . | |
| 3,735,796 | 5/1973 | Germain et al. | 164/165 |
| 3,743,138 | 7/1973 | Lyman . | |
| 3,814,127 | 6/1974 | Nikolov et al. . | |
| 3,899,021 | 8/1975 | Alexandrov et al. . | |
| 3,948,311 | 4/1976 | Sylvester . | |
| 4,188,010 | 2/1980 | Reiland . | |
| 4,380,261 | 4/1983 | Suzuki et al. . | |
| 4,436,140 | 3/1984 | Ebisawa et al. . | |
| 4,519,436 | 5/1985 | Ebisawa et al. . | |
| 4,614,630 | 9/1986 | Pluim, Jr. . | |
| 4,681,624 | 7/1987 | De Angelis et al. . | |
| 4,704,079 | 11/1987 | Pluim, Jr. . | |
| 4,928,746 | 5/1990 | Butler et al. . | |
| 4,961,460 | 10/1990 | Butler et al. . | |
| 5,076,341 | 12/1991 | Noguchi . | |
| 5,076,344 | 12/1991 | Fields et al. . | |
| 5,092,558 | 3/1992 | Katsura . | |
| 5,161,595 | 11/1992 | Garat . | |
| 5,161,598 | 11/1992 | Iwamoto et al. . | |
| 5,322,111 | 6/1994 | Hansma . | |
| 5,323,838 | 6/1994 | Hamashima et al. . | |
| 5,343,933 | 9/1994 | Schneider et al. . | |
| 5,647,426 | 7/1997 | Prieto et al. | 164/348 |

FOREIGN PATENT DOCUMENTS

| | | |
|---|---|---|
| 5732869 | 2/1982 | Japan . |
| 183360 | 3/1989 | Japan . |
| 241752 | 2/1990 | Japan . |
| 241753 | 2/1990 | Japan . |
| 275460 | 3/1990 | Japan . |
| 3142056 | 6/1991 | Japan . |

*Primary Examiner*—Patrick Ryan
*Assistant Examiner*—I.-H Lin
*Attorney, Agent, or Firm*—MacMillan, Sobanski & Todd, LLC

[57] ABSTRACT

A mold for gravity casting vehicle wheels having reusable thermally insulative linings attached to the interior of the gate and ball riser cavities. After filling the mold with molten metal, the gate cavity can be pressurized to assure that the mold cavity is completely filled. The ball riser cavity also can be pressurized subsequent to the gate cavity pressurization. The pressure on the gate and ball riser cavities forces molten metal from the cavities into the mold cavity as the metal cools and solidifies.

18 Claims, 5 Drawing Sheets

METHOD AND APPARATUS FOR CASTING A VEHICLE WHEEL IN A PRESSURIZED MOLD

CROSS REFERENCE TO A RELATED APPLICATION

This application is a continuation-in-part of U.S. patent application Ser. No. 08/430,069, filed Apr. 27, 1995, and now abandoned.

BACKGROUND OF THE INVENTION

The invention relates in general to gravity casting of metal components and in particular to gravity casting of vehicle wheels.

Vehicle wheels have a circular wheel disc attached to an annular wheel rim. The wheel disc includes a central wheel hub having a pilot hole and plurality of wheel mounting holes formed therethrough. A plurality of equally circumferentially spaced spokes typically support the wheel hub within the wheel rim. The wheel rim is adapted to support a pneumatic tire.

In the past, vehicle wheels typically have been formed entirely from steel. However, wheels formed from light weight metals, such as aluminum, magnesium and titanium or alloys thereof, are becoming increasingly popular. In addition to weighing less than conventional all-steel wheels, such light weight wheels can be manufactured having a pleasing esthetic shape. Weight savings also can be achieved by attaching a wheel disc formed from a light weight metal alloy to a steel wheel rim.

Light weight wheels are typically formed by forging or casting operations. During a forging operation, a heated billet of the light weight metal alloy is squeezed by very high pressure between successive sets of dies until the final shape of the wheel is formed. During a casting operation, molten metal is poured into a cavity formed in a multi-piece wheel mold. After the metal cools sufficiently to solidify, the mold is opened and a rough wheel casting is removed. The wheel casting is then machined to a final shape. machining can including the outside and inside surfaces of the wheel rim, facing the inboard and outboard wheel disc surfaces and drilling the center pilot hole and the mounting holes through the wheel hub.

Conventional casting operations include numerous processes, such as die casting, low pressure injection casting and gravity casting. All the conventional casting operations typically utilize a wheel mold formed from a number of segments. The wheel mold defines a mold cavity which includes a rim cavity for casting the wheel rim and a disc cavity for casting the wheel disc.

For high volume production of castings, such as vehicle wheels, a highly automated gravity casting process is frequently used. Such automated gravity casting processes typically use a casting machine having a plurality of molds mounted upon a moving structure, such as a rotatable carousel. Each mold is indexed past a refractory furnace containing a pool of molten metal. A charge of molten metal is poured into a gate formed in the mold which communicates with the mold cavity. Gravity causes the metal to flow from the gate into the mold cavity, filling the rim and disc cavities. The mold and the molten metal cool as the casting machine indexes the other molds to the refractory furnace for charging with molten metal. After a sufficient cooling time has elapsed, the mold is opened and the wheel casting removed. The mold is then closed and again indexed to the refractory furnace to be refilled with molten metal.

As the molten metal in the mold cavity cools, it also contracts, or shrinks in volume. Such shrinkage can mar the appearance of the wheel and form voids within the wheel. If a void extends through the wheel, the inflation air of a tire mounted upon the wheel will leak through the void, causing the tire to deflate. Accordingly, cast wheels are carefully checked and wheels which have surface imperfections or which are "leakers" are rejected. In an effort to reduce the number of wheels rejected, wheel molds are usually designed having a relatively large radial spacing between the surfaces of the rim cavity and a relatively large axial spacing between the surfaces of the disc cavity. These spacings produce a wheel casting having an additional volume of metal in the wheel rim and disc. The additional volume of metal allows deeper machining of the wheel casting to remove surface imperfections. The additional volume of metal also results in a wheel rim having a relatively large radial dimension and a wheel disc having a relatively large axial dimension, which reduces the possibility of an internal void extending through the wheel.

To further reduce the number of wheels rejected, a ball riser cavity and a rim riser cavity are typically formed above the center of the disc cavity and at the inboard end of the rim cavity, respectively. These riser cavities receive and store additional molten metal during the pouring operation. As the molten metal within the rim and disc cavities cools and shrinks, gravity draws additional molten metal from the riser cavities into the rim and disc cavities. This additional metal fills any voids that are formed by the shrinkage. The metal remaining in the riser cavities cools to form a center ball riser and an annular rim riser on the casting. Similarly, any metal remaining in the mold gate forms a sprue on the casting. The casting risers and sprue are typically sawed from the casting during the first machining operation.

SUMMARY OF THE INVENTION

The present invention is directed towards an improved vehicle wheel mold which has reusable linings formed from a thermally insulating material mounted within its ball riser and gate cavities and a process for gravity casting vehicle wheels which utilizes the improved mold.

As described above, gravity cast wheels are typically formed having an additional volume of metal to reduce the rate of rejection of wheels due to surface voids and leakage through the wheel. However, the use of the additional volume of metal requires a longer machining time to finish the casting. The additional volume of metal also increases the wheel weight. Therefore, there is a need for an improved mold and a process for forming wheel castings without including the additional metal.

The invention contemplates a mold for gravity casting metal components, such as vehicle wheels. The mold includes a base segment and a top segment which cooperate with side segments to define a mold cavity. The mold cavity communicates with a storage cavity formed in the mold separate from the mold cavity. The storage cavity is adapted to receive and store molten metal. A reusable thermally insulative liner is disposed within the storage cavity and attached to the mold segments. The liner retards the solidification of molten metal contained in the storage cavity.

The mold can further include an apparatus for applying a force to molten metal contained in the storage cavity subsequent to filling the mold cavity and storage cavity with molten metal. The apparatus for applying a force can use a pressurized gas or a mechanical device to apply the force. The force urges molten metal from the storage cavity into the mold cavity.

The storage cavity can form a ball riser cavity for a vehicle wheel mold. Additionally, the storage cavity can form a gate for supplying molten metal to the mold cavity. A filter element can be disposed within the gate.

The invention also contemplates a process for casting a metal component such as a vehicle wheel, which includes the steps of pouring molten metal into the above described mold. After completing the pouring of the molten metal, a force is applied to the molten metal in the storage cavity to urge the molten metal contained therein into the mold cavity. The force is maintained for a predetermined time period.

Various objects and advantages of the invention will become apparent to those skilled in the art from the following detailed description of the preferred embodiment, when read in light of the accompanying drawings.

DETAILED DESCRIPTION OF THE PREFERRED EMBODIMENT

Figure 1:
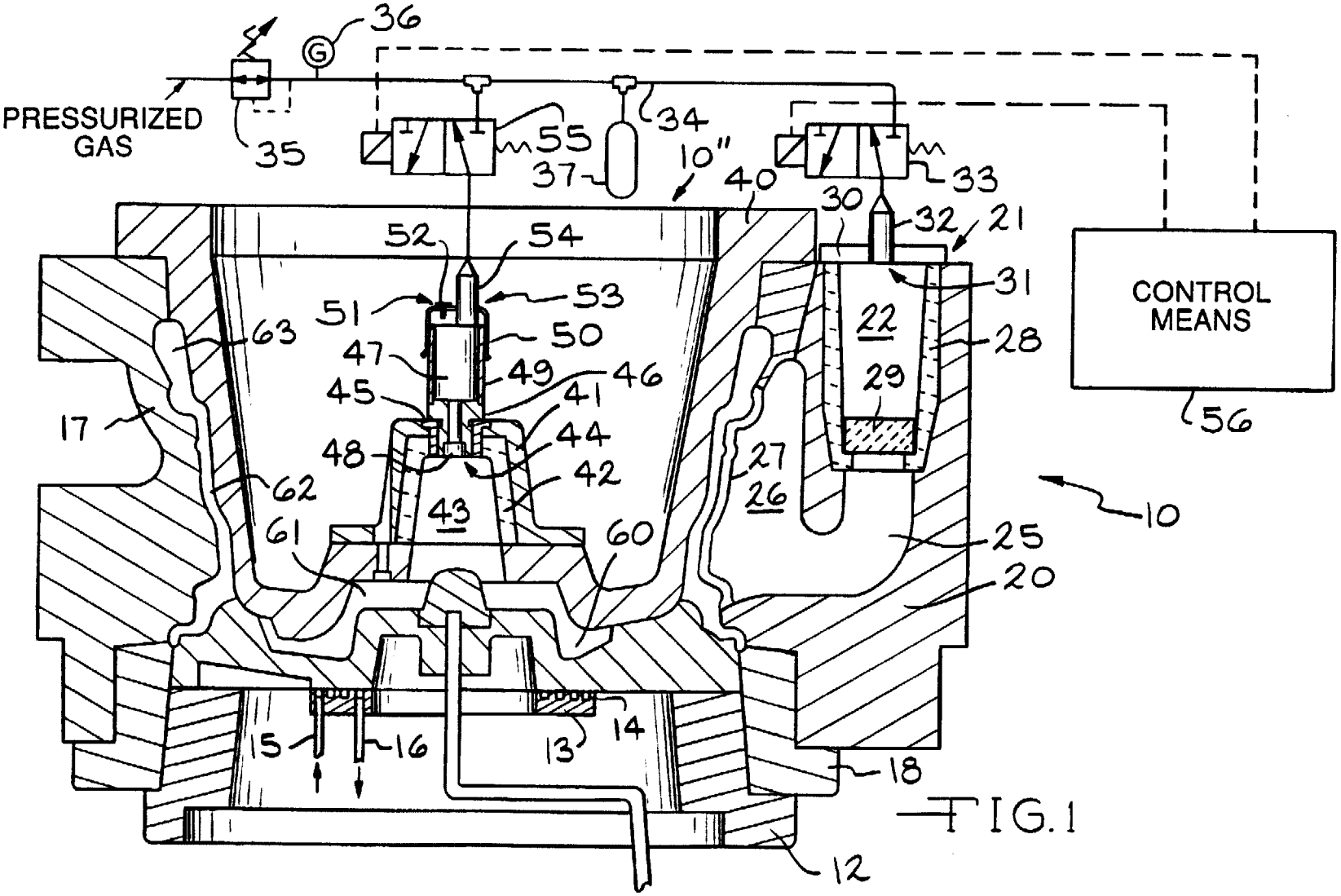
FIG. 1 shows an apparatus for gravity casting vehicle wheels in accordance with the invention.

Referring now to FIG. 1, there is shown an apparatus 10 for gravity casting vehicle wheels in accordance with the invention. The apparatus 10 includes a multiple piece mold 11, which is shown in section in FIG. 1. The mold 11 is formed from a high temperature resistant metal, such as steel. While the mold 11 shown in FIG. 1 is designed for gravity casting vehicle wheels, it will be appreciated that the particular mold 11 shown is for illustrative purposes and that the invention can be practiced on molds for gravity casting of other metal components. Additionally, while the mold 11 shown in FIG. 1 is designed for casting a complete one piece wheel, the invention also can be practiced on a mold for gravity casting a wheel component, such as a wheel disc or a partial wheel rim.

The mold 11 includes a base segment 12 which can include a plurality of subsegments. In the preferred embodiment shown in FIG. 1, the base segment 12 has an annular cooling block 13 mounted upon its bottom. The cooling block 13 is formed from a highly heat conductive metal and has a spiral shaped cooling passageway 14 formed therein which receives a cooling medium through an inlet conduit 15 and discharges the cooling medium through an outlet conduit 16. Various cooling mediums, such as water, air, a mist of water and air or cold gases can be circulated through the passageway 14 to accelerate cooling of the mold 11.

The mold 11 further includes a pair of movable side segments 17 and 18 which are supported by the base segment 12. Each of the side segments 17 and 18 can include a plurality of subsegments. The side segments 17 and 18 can be extended to a closed position or retracted to an open position by a conventional mechanism which, for clarity, is not shown in FIG. 1. The side segment 18, which is shown on the right in FIG. 1, includes a gate member 20 extending from the side thereof. The gate member 20 has a gate 21 formed therein. As explained above, the gate 21 receives molten metal for casting the wheel. The gate 21 includes a cylindrical inlet chamber 22 into which the molten metal is poured. The inlet chamber 22 communicates through a gate passageway 25 with an intermediate chamber 26 formed within the gate member 20. A narrow axial opening 27 is formed through the inner wall of the intermediate chamber 26, the purpose for which will be explained below.

The apparatus 10 also includes a cylindrical insert, or liner, 28 disposed in the gate inlet chamber 22. The insert 28 is formed from a thermally insulating material, which, in the preferred embodiment, is a ceramic, such as, for example, alumina, zirconia, silicon carbide or mica. Alternately, the insert 28 can be formed from other suitable highly insulating materials, or a combination of such materials. A filter 29, which is formed from a porous material, which in the preferred embodiment is a ceramic, such as, for example, alumina foam, zirconia, silicon carbide or mica, is disposed across the base of the insert 28. Alternately, the filter 29 can be formed from other suitable highly insulating materials, or a combination of such materials The apparatus 10 further includes a gate cover 30 which is movable between open and closed positions by a movement mechanism (not shown), which is conventional in the art. The gate cover 30 is shown in FIG. 1 in the closed position covering the upper end of the inlet chamber 22. The movement mechanism urges the gate cover 30 against the upper end of the inlet chamber 22 to form a seal therewith. The gate cover 30 is movable to the open position (not shown) to allow access to the gate 21 for pouring molten metal into the mold 11. The gate cover 30 has an opening 31 formed therethrough which receives a first section of pipe 32. The first section of pipe 32 is connected through a first, two position, three way solenoid valve 33 to a pressurized gas supply line 34. A pressure regulator valve 35 connects the pressurized gas supply line 34 to a source of pressurized gas. In the preferred embodiment, the plant compressed air supply is used as the source of pressurized gas. However, other pressurized gases can be used. For example, an inert gas, such as nitrogen can be used to eliminate potential oxidation of the molten metal. A gas accumulator 37 communicates with the supply line 34. The purpose of the accumulator 37 will be described below.

The pressure regulator valve 35 is adjusted to supply pressurized gas from the source to the supply line 34 at a reduced pressure. The gas pressure utilized is a function of the particular mold configuration, however, in the preferred embodiment 50 psig (350 kp) is the maximum pressure. A gas pressure gauge 36 provides a visual indication of the gas pressure in the supply line 34. As shown in FIG. 1, the first solenoid valve 33 normally connects the gate inlet chamber 22 to the atmosphere. Upon energizing the valve solenoid, the first solenoid valve 33 is operable to connect the regulated supply of pressurized gas to the gate inlet chamber 22.

The side segments 17 and 18 receive an axially movable top segment 40. The top segment 40 can be extended to a closed position and retracted to an open position by a conventional mechanism which, for clarity, is not shown in FIG. 1. Similar to the other segments, the top segment 40 can include a plurality of subsegments. A ball riser segment 41 having an inverted cup shape is mounted in the center of the top segment 40. The ball riser segment 41 includes a cup shaped liner 42 formed from a thermally insulating material, which, in the preferred embodiment, is a ceramic, such as, for example, alumina, zirconia, silicon carbide or mica. Alternately, the liner 42 can be formed from other suitable highly insulating materials, or a combination of such materials. The liner 42 defines a chamber which is referred to in the following as a ball riser cavity 43.

Figure 2:
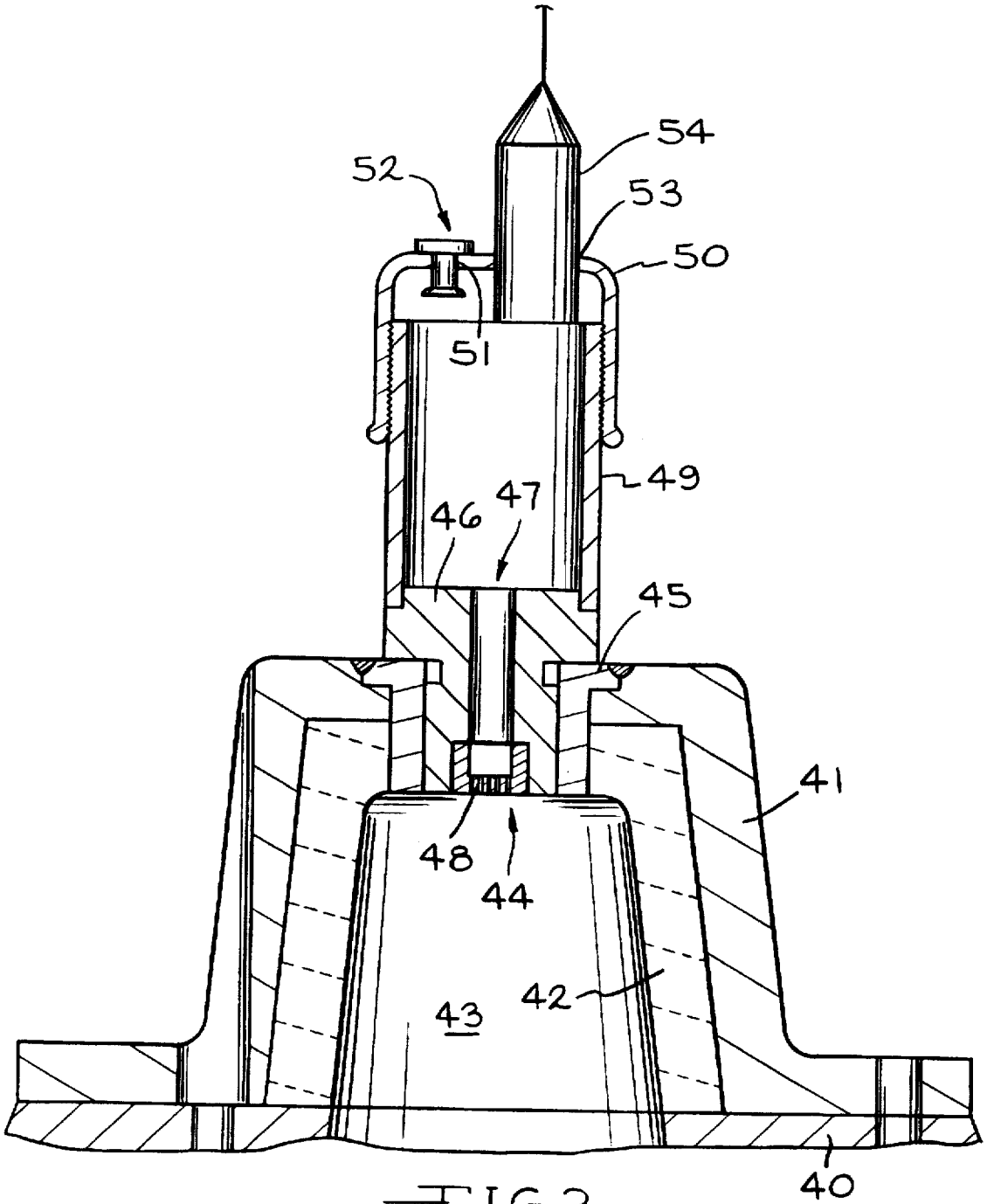
FIG. 2 is an enlarged fragmentary sectional view of a portion of the apparatus shown in FIG. 1.

As best seen in FIG. 2, a vent opening 44 is formed through the top of the ball riser segment 41 and liner 42. The vent opening 44 receives a cylindrical vent plug bushing 45. The vent plug bushing 45 carries a vent plug 46 which has an upper end extending above the vent plug bushing in FIG. 2. The vent plug bushing 45 also has an axial bore 47 formed therethrough. A slotted vent 48 is disposed in the lower end of the vent plug bore 47. A tubular transition member 49 is welded to the upper end of the vent plug 46. The upper end of the transition member 49 is threaded and receives a threaded cap 50. The cap 50 has a first opening 51 formed therethrough which receives a check valve 52, the purpose for which will be explained below. The cap 51 also has a second opening 53 formed therethrough which receives a second section of pipe 54.

The second section of pipe 54 is connected through a second, two position, three way solenoid valve 55 to the regulated pressurized gas supply line 34. As shown in FIG. 1, the second solenoid valve 55 normally connects the ball riser 43 to the atmosphere. However, upon energizing the valve solenoid, the second solenoid valve 55 is operable to connect the regulated supply of pressurized gas to the ball riser 43. The solenoids of both the first and second valves 33 and 55 are connected to a control means 56 which, as will be described below, is operative to selectively energize the solenoids.

When the top and side segments 40, 17 and 18 are extended to their closed positions, the mold 11 is closed and the top segment 40 cooperates with the base segment 12 and the side segments 17 and 18 to define a mold cavity 60 for casting a vehicle wheel. The mold cavity 60, as shown in FIG. 1, includes a generally circular disc cavity 61 for casting the wheel disc and an annular rim cavity 62 for casting the wheel rim. The disc cavity 61 communicates with the ball riser cavity 43 while the rim cavity 62 terminates in an annular rim riser cavity 63. For reasons to be explained below, the rim riser cavity 63 is formed having a greater volume than a typical prior at wheel mold. As described above, the axial opening 27 in the side segment 18 provides communication between the gate intermediate chamber 26 and the mold cavity 60.

The operation of the apparatus 10 will now be described. The side and top segments 17, 18 and 40 are moved to their extended positions to close the mold 11. The gate cover 30 is moved to its open position, exposing the end of the gate inlet chamber 22. Molten metal is poured into the gate 21. Gravity causes the molten metal to flow through the filter 29 and the gate passageway 25 and into the intermediate chamber 26. The filter 29 removes oxides and other impurities form the molten metal. The filter 29 also reduces turbulence in the molten metal as the mold cavity 60 is filed, reducing oxidation of the molten metal. From the intermediate chamber 26, molten metal flows through the axial opening 27 and into the mold cavity 60. The molten metal flows across the disc cavity 61 and into the ball riser cavity 43. The check valve 51 in the ball riser cap 50 is open and vents air and other gases trapped in the center of the mold cavity 60, allowing the molten metal to fill the riser cavity 43. Similarly, molten metal fills the rim cavity 62 and enters the rim riser cavity 63. Pouring continues until the gate inlet chamber 22 is filled with molten metal.

The ceramic liner 28 in the gate inlet chamber 22 prevents contact between the molten metal and the gate member 20, insulating the molten metal from the surface of the inlet chamber 22. Consequently, a skin of solidified metal is not formed and the metal in the inlet chamber 22 remains molten. Similarly, the ceramic liner 42 in the ball riser segment 41 prevents contact between the molten metal and the ball riser segment 41, insulating the molten metal from the surface of the ball riser segment 41. Thus, the metal in the ball riser cavity 43 also is maintained in its molten state and a skin of solidified metal is prevented from forming.

After the molten metal is poured into the mold 11, the gate cover 30 is moved to its closed position, covering and forming a seal with the upper end of the gate inlet chamber 22. The first solenoid valve 33 is then energized by the control means 55 to supply pressurized gas through the first section of pipe 32 to the gate inlet chamber 22. The pressurized gas exerts a force on the molten metal which is in the inlet chamber 22. The force urges the molten metal through the filter 29 and into the intermediate chamber 26 and the mold cavity 60. This assures complete falling of the mold cavity 60 and the rim riser cavity 63. The rim riser cavity 63 is oversized to accommodate a portion of the molten metal from the gate inlet chamber 22. Additionally, the intermediate chamber 26 is completely filled with molten metal. The rim riser cavity 63 and intermediate chamber 26 provide additional molten metal to the mold cavity 60 as the metal contained therein cools and shrinks. This additional metal fill voids produced by the shrinkage. The pressurized gas also clears the molten metal from the filter 29 so that the filter 29 is excluded from the wheel casting sprue. This eliminates any contamination from the filter 29 when the sprue scrap is remelted. The first solenoid valve 33 remains operative to maintain the pressure applied to the gate 21.

When the pressurized gas contacts the molten metal in the gate inlet chamber 22, the gas is heated and expands. If the heated gas is retained in the fixed volume of the gate inlet chamber 22, the gas pressure would increase above the desired magnitude. However, the gas accumulator 37 communicates with the gate inlet chamber 22 and absorbs the gas pressure increase. The gas accumulator 37 is sized to have a much larger volume than the volume of gas being heated. For reasons which are given below, the volume of the gas accumulator 37 is a function of the combined gas volumes remaining in the gate inlet chamber 22 and the ball riser cavity 43 after the mold 11 is filled.

The molten metal in the mold cavity 60 is allowed to begin to cool and soldify for a first period of time after filling is completed, which, in the preferred embodiment is 60 seconds. After the first predetermined time period has elapsed, the second solenoid valve 55 is energized to supply pressurized gas to the ball riser cavity 43. The pressurized gas closes the check valve 52 and exerts a force on the molten metal in the ball riser cavity 43. The force urges the molten metal back into the disc cavity 61, filling any voids created by metal shrinkage. The pressurization of the ball riser cavity 43 is maintained for a second predetermined period of tie during which the casting continues to solidify. In the preferred embodiment, the second predetermined time period is 60 seconds. However, it will be appreciated that a longer period of time can be used.

As shown in FIG. 1, the ball riser cavity 37 communicates with the gas accumulator 37. Thus, any increase in gas pressure which results from heating of the pressurized gas supplied to the ball riser cavity 43 is absorbed by the gas accumulator 37.

The solidification of the casting can be accelerated by circulating a cooling medium through the passageway 14 formed in the cooling block 13. However, while a cooling block 13 is shown in the preferred embodiment of the invention, the use of the cooling block 13 is optional and the invention can be practiced without the cooling block 13.

Likewise, it will be appreciated that the invention also can be practiced with additional cooling passageways formed on other portions of the mold 11 to accelerate and control cooling of the casting.

After the second predetermined time period has elapsed, both solenoid valves 33 and 55 are deenergized by the control means 56, allowing the pressurized gas in the gate inlet chamber 22 and the ball riser cavity 43 to vent to atmosphere. The gate cover 30 is moved to the open position, exposing the upper end of the gate inlet chamber 22. Following sufficient cooling time, the mold 11 is opened, allowing removal of the wheel casting. After the wheel casting is removed from the mold 11, a new filter 29 can be inserted into the gate inlet chamber 22 and the mold 11 is ready to repeat the cycle to cast another wheel.

The inventors have found that the apparatus 10 reduces the rejection rate of wheel castings because the pressurization of the mold 10 causes the molten metal to fill voids in the casting during cooling. Accordingly, the apparatus 10 allows reduction of the radial spacing between the surfaces of the rim cavity and the axial spacing between the surfaces of the disc cavity. This reduces the amount of metal contained in the wheel castings. The resulting wheels are lighter and have rims with a smaller radial dimension and discs with a smaller axial dimension than prior art wheels. These reduced dimensions reduce the amount of machining required to finish the castings. The quality of the wheel surfaces are improved since the pressurization of the mold 11 forces the molten metal into contact with he mold cavity surfaces. The pressurization of he mold 11 also increases the density of the metal in the resulting wheel, improving the wheel mechanical strength by providing stronger components, such as the hub and spokes. Additionally, the pressurization of the mold 11 enhances the flow of molten metal into the mold cavity 60.

It will be appreciated that, while the preferred embodiment of the invention contemplates sequentially pressurizing both the ball riser cavity 43 and the gate inlet chamber 22, the invention can be practiced with only a pressurized ball riser cavity 43 or only a pressurized gate inlet chamber 22.

It will also be appreciated that the invention can be practiced without the insulating lining in the ball riser cavity 43 and gate inlet chamber 22.

Figure 3:
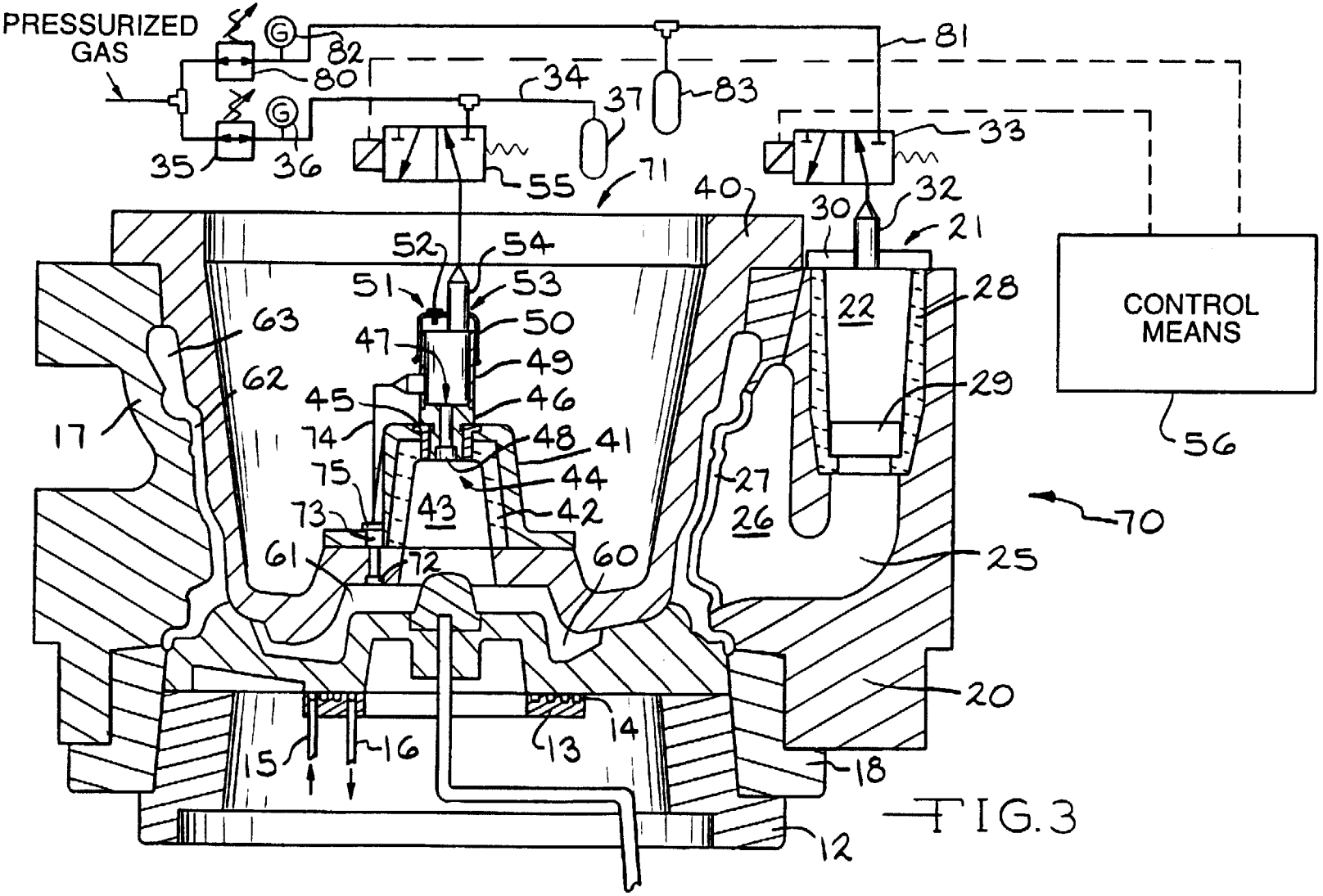
FIG. 3 illustrates an alternate embodiment of the apparatus shown in FIG. 1.

An alternate embodiment of the apparatus is illustrated generally at 70 in FIG. 3. Components of the alternate embodiment of the apparatus 70 which are identical to the components shown for the apparatus 10 in FIG. 1 are labeled with the same numerical designators.

The alternate embodiment of the apparatus 70 includes a slotted vent plug 72 which is disposed in the bottom of a bore 73 formed through the top segment 40 adjacent to the inboard face of the casting hub. The vent plug 72 is typically included to provide additional venting of the disc cavity 61. The alternate embodiment of the apparatus 70 contemplates a gas line 74 which has one end connected to the transition piece 49. The other end of the gas line 74 is attached to a compression fitting 75 which is secured to the top of the bore 73. Thus, when pressurized gas is applied to the ball riser cavity 43, the pressurized gas is also applied through the gas line 74 to the vent plug 72 to pressurize another portion of the disc cavity 61. While one gas line 74 has been shown in FIG. 3, it will be appreciated that a plurality of gas lines 74 can be installed to supply pressurized gas to a plurality of similar vent plugs (not shown).

The alternate embodiment of the apparatus 70 also contemplates a second adjustable pressure regulator valve 80, which is connected between the source of pressurized gas and a second pressurized gas supply line 81. The second supply line 81 is connected to the first solenoid valve 33. A second pressure gauge 82 is included to provide a visual indication of the gas pressure in the second supply line 81. A second gas accumulator 83 communicates with the second supply line 81. The second pressure regulator valve 80 is operable to supply gas to the ball riser cavity 43 at a pressure which is different from the pressure of the gas supplied to the gate inlet chamber 22.

Figure 4:
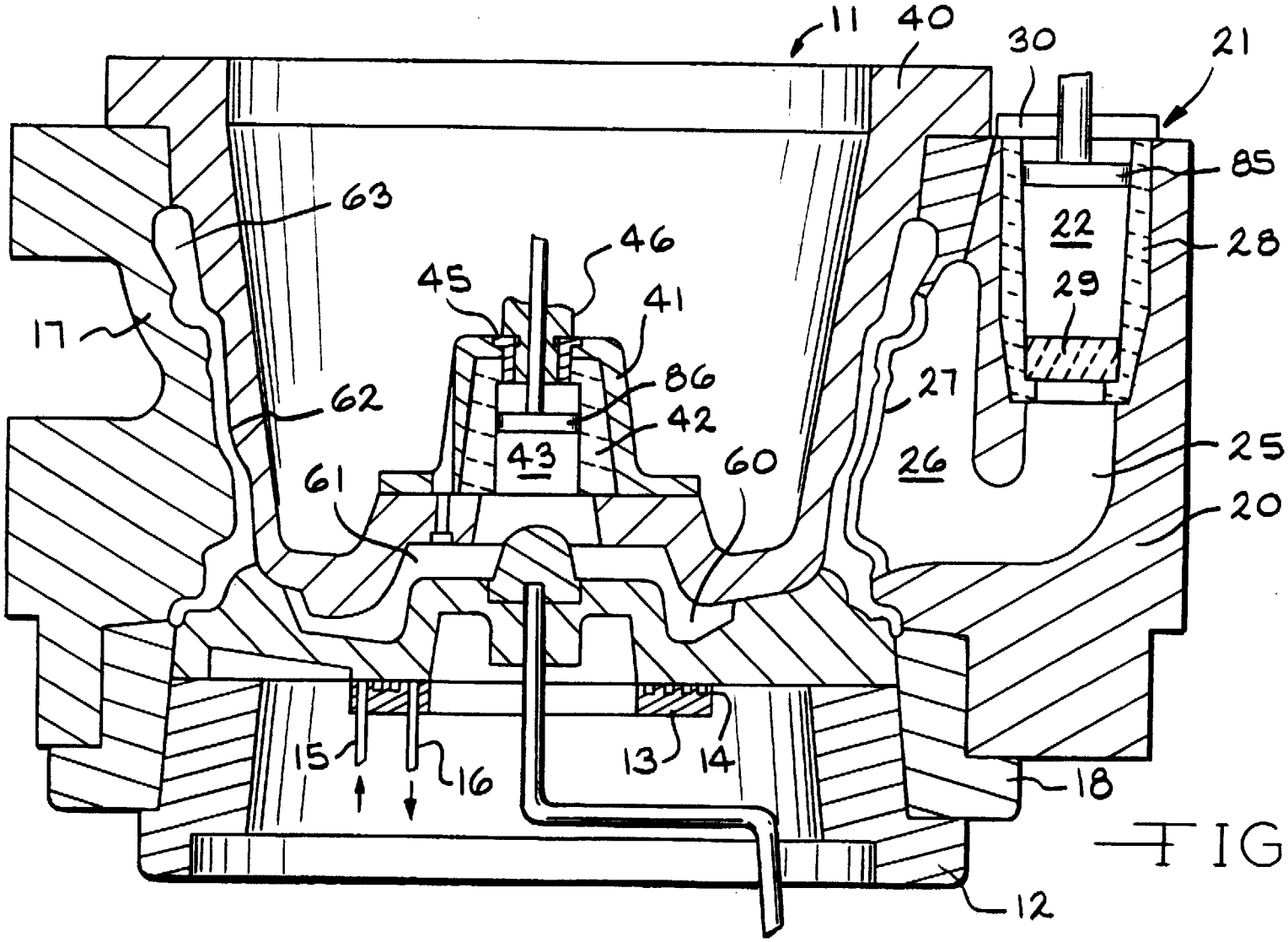
FIG. 4 illustrates another alternate embodiment of the apparatus shown in FIG. 1.

It will be appreciated that, while the invention has been shown utilizing a pressurized gas to apply force to molten metal in the gate inlet chamber 22 and ball riser chamber 43, it is also contemplated that the invention can be practiced by using a mechanical device, such as, for example a piston, to apply the force. FIG. 4 shows slidably movable pistons 85 and 86 disposed within the gate inlet chamber 22 and ball riser chamber 43, respectively. The pistons 85 and 86 are connected to a conventional mechanism (not shown) for slidable movement within the gate inlet chamber 22 and ball riser chamber 43.

Figure 5:
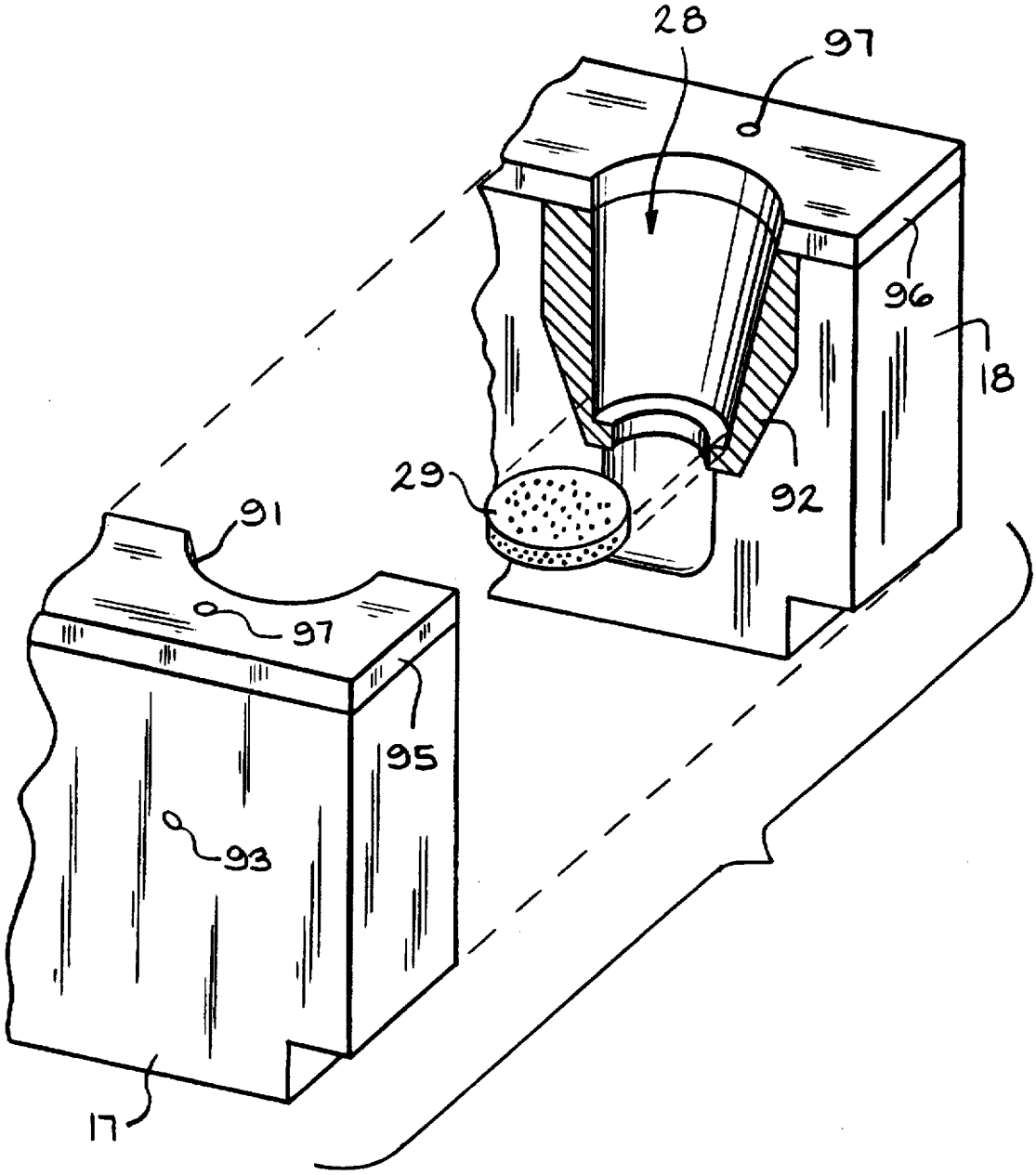
FIG. 5 is a partial perspective view of a portion an alternate embodiment of the apparatus shown in FIG. 1.

The present invention further contemplates that the insert, or liner, 28 disposed within the gate inlet chamber 22 includes a first half 91 which is removalbly mounted upon one of the side segments 17 and a second half 92 which is removably mounted upon the other of the side segments 18, as shown in FIG. 5. As indicated above, the insert halves 91 and 92 are formed from a thermally insulative material, such as a ceramic. In the preferred embodiment, the insert halves 91 and 92 are secured by first threaded fasteners 93 (one shown) which extend through the side segments 17 and 18 and into the insert halves 91 and 92. Additionally, the insert halves 91 and 92 are clamped in the gate inlet chamber 22 by a pair of removable top plates 95 and 96 which are attached to the side segments 17 and 18, respectively. A second plurality of threaded fasteners 97 extend through the top plates 95 and 96 and into the upper portion of the insert halves 91 and 92.

As described above, a filter 29, which in the preferred embodiment is formed from a porous thermally insulative material, such as a ceramic, as disposed in gate inlet chamber 22 at the bottom of the insert 28. The filter 29 removes oxides from the molten metal charge and reduces turbulence thereof during the pouring of the metal into the mold gate 21. The reduction of turbulence reduces the formation of additional oxides in the molten metal and assures a smooth, tranquil entry of the molten metal charge into the mold cavity 60.

The invention further contemplates that the liner halves 91 and 92 remain mounted upon the side segments 17 and 18 as the segments are extended and retracted for casting wheels. The inventors have found that the same liner halves can be reused for repeated wheel castings. Accordingly, it is not necessary to replace the liners between casting operations, as in conventional foundry practice for casting other components. This is especially advantageous for automated gravity casting machinery where it is not practical to replace the insert 28 after each wheel is cast. The inventors have used the same insert 28 to cast over 300 wheels.

During a conventional gravity casting operation, the insert 28 preserves the metal within the gate inlet chamber 22 in a molten state. The molten metal in the gate inlet chamber 22 is drawn into the mold cavity 60 as the metal forming the wheel casting solidifies and contracts. Additionally, the thermally insulative property of the insert 28 maintains the temperature of the molten metal to assure that the foam filter 29 is properly primed. Without the insert 28, the molten metal loses enough temperature upon directly contacting the side segment metal that the filter 29 is only partially primed. A partially primed filter is only partially used and can cause the charge of molten metal to backup and overflow from the gate 21. Thus, the present invention improves the casting process by including a reusable thermally insulative liner 28 in the gate inlet chamber 22 without increasing the time or required or complexity of casting a vehicle wheel.

Upon opening the mold 11 to withdraw the wheel casting, the filter 29 remains cast in the sprue. The sprue is removed from the wheel casting as scrap in a subsequent operation. The filter 29 is then removed from the scrap sprue by a conventional method, such as sawing, before the scrap sprue is remelted for casting more wheels. Removal of the filter prevents contamination of the molten metal. A new filter 29 is positioned in the bottom of the insert 28 before the next wheel is cast.

Alternately, the apparatus described above can be used to apply a force to the molten metal to urge the molten metal from the gate inlet chamber 22 and completely through the filter 29. The force can be applied with a pressurized gas or a mechanical device, such as the piston shown in FIG. 4. When a force is applied to the molten metal, the filter 29 can be removed from gate inlet chamber 22 after the liner halves 91 and 92 are opened with the retraction of the side cores 17 and 18. It then is not necessary to separate the used filter from the wheel sprue. Furthermore, the force will urge the molten metal into any voids within the mold cavity 60 caused by contraction of the wheel casting.

While the invention has been illustrated and described as having the insert halves 91 and 92 mounted directly upon the side segments 17 and 18, it will be appreciated that the gate member 20 shown in FIGS. 1 through 4 can be divided into two portions (not shown), each of which is attached to one of the side segments 17 and 18. The insert halves 91 and 92 would then be mounted upon the corresponding gate member portions.

The invention further contemplates that the cup shaped ball riser liner 42, which is formed from a thermally insulative material, is attached to the ball riser segment 41 and movable therewith as the top segment 40 is extended and retracted. In the preferred embodiment, the liner 42 is clamped between the ball riser segment 41 and the top segment 40. Alternately, a plurality of threaded fasteners (not shown) can be used to secure the liner to the ball riser segment 42 and/or the top segment 40.

The invention also contemplates that the same ball riser liner 42 is used to cast a plurality of vehicle wheels. The inventors have used the same ball riser liner for casting over 300 wheels. The reuse of the liner 42 is especially advantageous since the location of the ball riser cavity 43 within the mold 11 is generally inaccessible and replacement of the ball riser liner 42 requires disassembly of the mold 11. Prior to this invention, this inaccessibility has precluded the use of a liner in the ball riser cavity of wheel molds used with automated gravity casting machines.

The invention contemplates that the ball riser liner 42 can be used in a conventional gravity casting operation where a portion of the molten metal charge flows from the mold cavity 60 into the ball riser cavity 43. The thermally insulative liner 42 reduces heat loss sufficiently that the metal within the riser chamber 43 remains in its molten state. As the metal in the mold cavity 60 solidifies and contracts, gravity urges the molten metal back into the mold cavity 60 from the riser cavity 43 to fill any voids. Alternately, the apparatus described above can be used to apply a force to the molten metal in the ball riser cavity 43 to urge molten metal into the mold cavity 60. The force can be applied to the molten metal with a pressurized gas, as illustrated in FIGS. 1 through 3, or a mechanical device, as illustrated in FIG. 4.

It will be appreciated that the invention can be practiced with both the gate inlet insert 28 and the ball riser liner 42 mounted on the same mold 11. Alternately, only one of the gate inlet insert 28 or the ball riser liner 42 can be mounted on the mold 11.

In accordance with the provisions of the patent statutes, the principle and mode of operation of the invention have been explained and illustrated in its preferred embodiment. However, it must be understood that this invention may be practiced otherwise than as specifically explained and illustrated without departing from its spirit or scope.

What is claimed is:

1. A mold for gravity casting a vehicle wheel, the mold comprising:

a base segment;

a top segment movable between a retracted position and an extended position;

first and second side segments movable between retracted positions and extended positions; said base, top and side segments cooperating when said top and side segments are in said extended poisons to define a mold cavity, said first and second side segments further cooperating when in said extended position to define a sprue; said sprue including a gate chamber adapted to receive molten metal, said gate chamber communicating with said mold cavity; and a reusable thermally insulative gate liner disposed within said gate chamber; said gate liner including a first portion mounted upon said first side segment and a second portion mounted upon said second side segment, said gate liner portions movable with said side segments.

2. A mold in accordance with claim 1 further including a filter disposed across the bottom of said gate liner.

3. A mold in accordance with claim 2 wherein said filter is formed from a porous ceramic foam.

4. A mold in accordance with claim 2 further including a pressure source connected to said gate chamber, said pressure source adapted to urge molten metal from said gate chamber into said gate chamber and said mold cavity; said pressure source operative to urge said molten metal completely through said filter and from said gate chamber.

5. A mold in accordance with claim 4 further including a central riser formed in said top segment adjacent to a bail forming portion of said mold cavity and communicating therewith, said mold further including a reusable thermally insulating liner disposed within said central riser.

6. A mold in accordance with claim 5 wherein said pressure source connected to said gate chamber is a first pressure source and further wherein the mold includes a second pressure source connected to said central riser, said second pressure source adapted to urge molten metal in said riser cavity into said mold cavity.

7. A mold in accordance with claim 6 wherein said first and second pressure sources use a pressurized gas to urge said molten metal from said gate chamber and said riser, respectively.

8. A mold in accordance with claim 7 further including a gas accumulator connected to said gate chamber and said riser, said accumulator receiving heated gas from said gate and said riser to maintain the pressure applied to said gate and said riser within a predetermined pressure range.

9. A mold in accordance with claim 6 wherein said first and second pressure sources mechanically urge said molten metal from said gate chamber and said riser, respectively.

10. A mold in accordance with claim 6 further including a controller, said controller operative to actuate said first pressure source to apply pressure to molten metal contained within said gate chamber for a first predetermined time period and, subsequent to said first time period elapsing, to actuate said second pressure source to apply pressure to molten metal contained within said riser.

11. A mold for gravity casting a vehicle wheel, the mold comprising:

a base segment;

a plurality of side segments movable between retracted positions and extended positions;

a top segment movable between a retracted and an extended position, said extended top segment cooperating with said base segment and said extended side segments to define a mold cavity for casting a vehicle wheel, said top segment further including a riser cavity formed adjacent to and communicating with a ball forming portion of said mold cavity; and a reusable thermally insulative liner mounted within said top segment riser cavity, said liner movable with said top segment such that said liner as used during multiple casting operations to form a plurality of wheel castings.

12. A mold as defined in claim 11 wherein said liner in said top segment riser is formed from a ceramic material.

13. A process for gravity casting a metal vehicle wheel comprising the steps of:

(a) providing a wheel mold having a base segment, a top segment movable between a retracted position and an extended position, first and second side segments movable between retracted positions and extended positions; the base, top and side segments cooperating when the top and side segments are in the extended positions to define a mold cavity, the first and second side segments further cooperating when in the extended position to define a sprue; the sprue including a gate chamber adapted to receive molten metal, the gate chamber communicating with the mold cavity, and a reusable thermally insulative gate liner disposed within the gate chamber; the gate liner including a first portion mounted upon the first side segment and a second portion mounted upon the second side segment, the gate liner portions movable with the side segments;

(b) placing a filter across the base of the first gate liner portion;

(c) closing the mold segments with the filter positioned across the base of the gate liner;

(d) pouring molten metal into the sprue, the liner maintaining the temperature of the molten metal such that the filter is thoroughly wetted with molten metal to allow the molten metal to flow into the mold cavity;

(e) allowing the metal to solidify within the mold cavity;

(f) opening the mold, the gate liner portions being carried by the mold segments and being retained thereon for casting a subsequent wheel; and (g) removing the wheel casting and the filter from the mold.

14. The process according to claim 13 further including subsequent to step (d), applying a pressure to the molten metal contained within the gate chamber and maintaining the pressure for a predetermined time period.

15. The process according to claim 14 wherein the pressure is sufficient to force the molten metal from the gate chamber and the filter.

16. A process for gravity casting a metal vehicle wheel comprising the steps of:

(a) providing a wheel mold having a base segment, a top segment movable between a retracted position and an extended position, first and second side segments movable between retracted positions and extended positions; the base, top and side segments cooperating when the top and side segments are in the extended positions to define a mold cavity, the top segment including a generally cylindrical riser cavity extending axially into the center of the top mold segment, the riser cavity being adjacent to the center portion of the mold cavity and communicating therewith, the riser cavity having a reusable thermally insulating liner attached thereto, the first and second side segments further cooperating when in the extended position to define a sprue; the sprue including a gate chamber adapted to receive molten metal, the gate chamber communicating with the mold cavity;

(b) pouring molten metal into the sprue, the metal flowing through the sprue and into the mold cavity with a portion of the molten metal entering the riser cavity, the liner maintaining the temperature of the molten metal within the riser cavity such that the molten state of the metal is maintained for a longer period of time in the riser cavity than in the mold cavity;

(c) allowing the metal to solidify within the mold cavity, the molten metal in the riser cavity being urged by gravity to reenter the mold cavity as the metal therein solidifies and contracts;

(d) opening the mold, the riser cavity liner being carried by the mold top segment and being retained thereon for casting a subsequent wheel; and (e) removing the wheel casting from the mold.

17. The process according to claim 16 further including subsequent to step (b), applying a pressure to the molten metal contained within the riser cavity and maintaining the pressure for a predetermined time period.

18. The process according to claim 17 wherein the pressure is sufficient to force molten metal from the riser cavity into the mold cavity to fill voids formed as the molten metal within the mold cavity solidifies and contracts.

* * * * *